US007591735B2

(12) United States Patent
Matsunaga et al.

(10) Patent No.: US 7,591,735 B2
(45) **Date of Patent: *Sep. 22, 2009**

(54) GOLF CLUB HEAD

(75) Inventors: Hideo Matsunaga, Saitama (JP); Wataru Ban, Saitama (JP); Hideo Shimazaki, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 462 days.

This patent is subject to a terminal disclaimer.

(21) Appl. No.: 11/435,984

(22) Filed: May 18, 2006

(65) Prior Publication Data

US 2007/0129168 A1 Jun. 7, 2007

(30) Foreign Application Priority Data

Dec. 5, 2005 (JP) ..... 2005-351281

(51) Int. Cl.
*A63B 53/04* (2006.01)

(52) U.S. Cl. ..... 473/329; 473/332; 473/350

(58) Field of Classification Search ..... 473/324–350, 473/287–292

See application file for complete search history.

(56) References Cited

U.S. PATENT DOCUMENTS 2,846,228 A * 8/1958 Reach ..... 473/332
3,084,940 A * 4/1963 Cissel ..... 473/332
4,804,188 A 2/1989 McKee et al.
4,811,950 A 3/1989 Kobayashi
4,928,972 A * 5/1990 Nakanishi et al. ..... 473/332
5,290,036 A * 3/1994 Fenton et al. ..... 473/332
5,299,807 A 4/1994 Hutin
5,316,298 A 5/1994 Hutin et al.
5,316,305 A 5/1994 McCabe
5,351,958 A 10/1994 Helmstetter
5,362,055 A 11/1994 Rennie
5,409,229 A 4/1995 Schmidt et al.
5,431,396 A 7/1995 Shieh
5,492,327 A 2/1996 Biafore, Jr.
5,529,543 A * 6/1996 Beaumont, Sr. ..... 473/290
5,564,705 A 10/1996 Kbbayashi et al.
5,586,947 A 12/1996 Hutin
5,643,111 A 7/1997 Igarashi
5,692,972 A 12/1997 Langslet
5,697,855 A * 12/1997 Aizawa ..... 473/350
5,703,294 A 12/1997 McConnell et al.
5,766,092 A 6/1998 Mimeur et al.
5,766,093 A * 6/1998 Rohrer ..... 473/329
6,045,456 A 4/2000 Best et al.
6,093,116 A 7/2000 Hettinger et al.
6,265,475 B1 7/2001 Chifei et al.
6,302,807 B1 * 10/2001 Rohrer ..... 473/329
6,431,997 B1 * 8/2002 Rohrer ..... 473/324
6,616,546 B2 9/2003 Cho (Continued)

FOREIGN PATENT DOCUMENTS

EP 1757334 A1 2/2007

(Continued)

*Primary Examiner*—Sebastiano Passaniti
(74) *Attorney, Agent, or Firm*—Sughrue Mion, PLLC

(57) ABSTRACT

This invention provides a golf club head having a viscoelastic body, wherein the viscoelastic body is made by mixing a plurality of types of viscoelastic materials with loss coefficients temperature dependences of which are different.

8 Claims, 5 Drawing Sheets

U.S. PATENT DOCUMENTS

| | | | | |
|---|---|---|---|---|
| 6,642,308 | B2 | 11/2003 | Nomura et al. | |
| 6,672,975 | B1 | 1/2004 | Galloway | |
| 6,688,989 | B2 * | 2/2004 | Best | 473/332 |
| 6,743,114 | B2 * | 6/2004 | Best | 473/291 |
| 6,743,117 | B2 * | 6/2004 | Gilbert | 473/332 |
| 6,773,360 | B2 | 8/2004 | Willett et al. | |
| 6,780,123 | B2 | 8/2004 | Hasebe | |
| 6,835,144 | B2 * | 12/2004 | Best | 473/332 |
| 6,855,066 | B2 * | 2/2005 | Best | 473/291 |
| 6,902,495 | B2 * | 6/2005 | Pergande et al. | 473/332 |
| 6,984,180 | B2 | 1/2006 | Hasebe | |
| 6,991,559 | B2 | 1/2006 | Yabu | |
| 6,991,560 | B2 | 1/2006 | Tseng | |
| 7,048,647 | B2 | 5/2006 | Burrows | |
| 7,108,613 | B1 | 9/2006 | Gordon et al. | |
| 7,119,146 | B2 | 10/2006 | Tse et al. | |
| 7,182,698 | B2 | 2/2007 | Tseng | |
| 7,189,169 | B2 | 3/2007 | Billings | |
| 7,207,899 | B2 | 4/2007 | Imamoto | |
| 7,226,366 | B2 | 6/2007 | Galloway | |
| 7,303,485 | B2 * | 12/2007 | Tseng | 473/332 |
| 7,303,486 | B2 * | 12/2007 | Imamoto | 473/332 |
| 7,316,623 | B2 | 1/2008 | Imamoto | |
| 7,371,190 | B2 * | 5/2008 | Gilbert et al. | 473/332 |
| 2003/0027662 | A1 | 2/2003 | Werner et al. | |
| 2003/0092502 | A1 | 5/2003 | Pergande et al. | |
| 2004/0043830 | A1 | 3/2004 | Imamoto | |
| 2004/0053704 | A1 | 3/2004 | Gilbert | |
| 2004/0242339 | A1 * | 12/2004 | Gilbert et al. | 473/291 |
| 2005/0124437 | A1 | 6/2005 | Imamoto | |
| 2005/0148405 | A1 | 7/2005 | Imamoto | |
| 2005/0192116 | A1 | 9/2005 | Imamoto | |
| 2005/0197208 | A1 | 9/2005 | Imamoto | |
| 2006/0258480 | A1 * | 11/2006 | Hou et al. | 473/332 |
| 2007/0049400 | A1 | 3/2007 | Imamoto et al. | |
| 2007/0129160 | A1 | 6/2007 | Matsunaga et al. | |
| 2007/0129161 | A1 | 6/2007 | Matsunaga et al. | |
| 2007/0129162 | A1 | 6/2007 | Pan et al. | |
| 2007/0129164 | A1 | 6/2007 | Shimazaki et al. | |
| 2007/0129165 | A1 | 6/2007 | Matsunaga et al. | |
| 2007/0129166 | A1 | 6/2007 | Shimazaki et al. | |
| 2007/0129168 | A1 | 6/2007 | Matsunaga et al. | |
| 2007/0149313 | A1 | 6/2007 | Matsunaga et al. | |
| 2008/0020860 | A1 | 1/2008 | Imamoto | |

FOREIGN PATENT DOCUMENTS

| | | | |
|---|---|---|---|
| FR | 2717701 | A1 | 9/1995 |
| JP | 01-166779 | A | 6/1989 |
| JP | 05-028361 | U | 4/1993 |
| JP | 05147096 | A | 6/1993 |
| JP | 06-007486 | A | 1/1994 |
| JP | 06254183 | A | 9/1994 |
| JP | 06-319836 | A | 11/1994 |
| JP | 07-27630 | U | 5/1995 |
| JP | 07-148291 | A | 6/1995 |
| JP | 07-213656 | A | 8/1995 |
| JP | 08-206258 | A | 8/1996 |
| JP | 09-000666 | A | 1/1997 |
| JP | 09-122281 | A | 5/1997 |
| JP | 11114112 | A | 4/1999 |
| JP | 2000-116824 | A | 4/2000 |
| JP | 2000197718 | A | 7/2000 |
| JP | 2001000606 | A | 1/2001 |
| JP | 2001-170225 | A | 6/2001 |
| JP | 2004-313777 | A | 11/2001 |
| JP | 2003-093550 | A | 4/2003 |
| JP | 2003-102877 | A | 4/2003 |
| JP | 2003-250939 | A | 9/2003 |
| JP | 2003-265652 | A | 9/2003 |
| JP | 2003-265653 | A | 9/2003 |
| JP | 2003260153 | A | 9/2003 |
| JP | 2004-089434 | A | 3/2004 |
| JP | 2005-006763 | A | 1/2005 |
| JP | 2005-160947 | A | 6/2005 |
| JP | 2005-160948 | A | 6/2005 |
| JP | 3112038 | U | 6/2005 |
| JP | 2005-218510 | A | 8/2005 |
| JP | 2005-245519 | A | 9/2005 |
| JP | 2006000139 | A | 1/2006 |
| JP | 2006000435 | A | 1/2006 |
| WO | 9920358 | A1 | 4/1999 |

* cited by examiner

GOLF CLUB HEAD

FIELD OF THE INVENTION

The present invention relates to a golf club head and, more particularly, to a technique for controlling vibration of a golf club head by a viscoelastic body.

BACKGROUND OF THE INVENTION

A golf club head having a viscoelastic body has been proposed to improve the hitting impression or adjust the hitting sound on impact. When the viscoelastic body is attached, the vibration on impact is absorbed by the viscoelastic body to improve the hitting impression and decrease the hitting sound that is offensive to the player's ear. Japanese Utility Model Registration No. 3112038 discloses a golf club head having a plurality of types of elastic weights having different specific gravities and elasticities. Japanese Patent Laid-Open No. 2004-313777 discloses a golf club head having a plurality of types of elastic bodies having different hardnesses.

The present inventors inspected the resonance frequency of a golf club head alone. A plurality of resonance frequencies were confirmed in a range of approximately 4,000 Hz to 10,000 Hz. Therefore, to reduce the vibration of the golf club head effectively, it is desired to attach a viscoelastic body that can reduce the vibration within a wide frequency range to the golf club head. In general, however, there is a limit to the frequency range of a viscoelastic material that is effective to reduce vibration depending on the material. The present inventors also inspected the resonance frequency of the golf club as a whole. A plurality of resonance frequencies were confirmed in a range of approximately 2,000 Hz or less. Therefore, to reduce the vibration of the golf club as a whole, the vibration is preferably reduced within a wider frequency range.

SUMMARY OF THE INVENTION

The present invention has been made in order to overcome the deficits of prior art.

According to the aspects of the present invention, there is provided a golf club head having a viscoelastic body, wherein the viscoelastic body is made by mixing a plurality of types of viscoelastic materials with loss coefficients the temperature dependences of which are different.

The temperature dependence of the loss coefficient (so-called tan δ) of a viscoelastic material represents the degree of the vibration attenuating effect of the viscoelastic material at any given temperature, and is related to the degree of the vibration attenuating effect of the viscoelastic material at any given frequency. More specifically, relatively, whereas a viscoelastic material with a large loss coefficient at a low temperature provides a high vibration attenuating effect in a high frequency band, a viscoelastic material with a large loss coefficient at a high temperature provides a high vibration attenuating effect in a low frequency band.

Therefore, when a plurality of types of viscoelastic materials with loss coefficients the temperature dependences of which are different are mixed, a viscoelastic body which can reduce vibration in a wider frequency range can be obtained. Such a viscoelastic body cannot be obtained from a single viscoelastic material. When the mixed viscoelastic body is mounted in a golf club, variation in a wider frequency range can be reduced.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Figure 1:
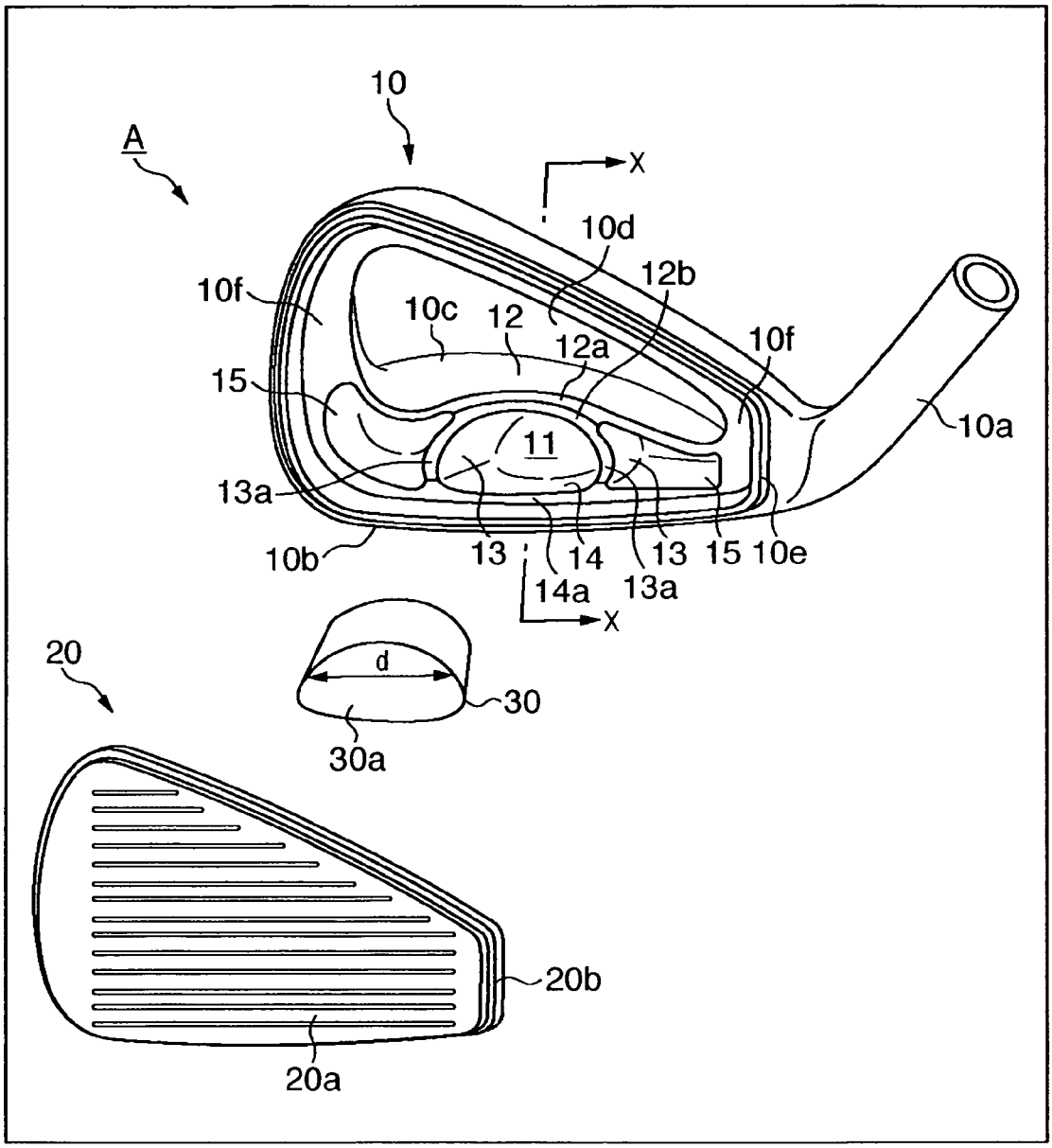
FIG. 1 is an exploded perspective view of a golf club head A according to one embodiment of the present invention.
Figure 2A:
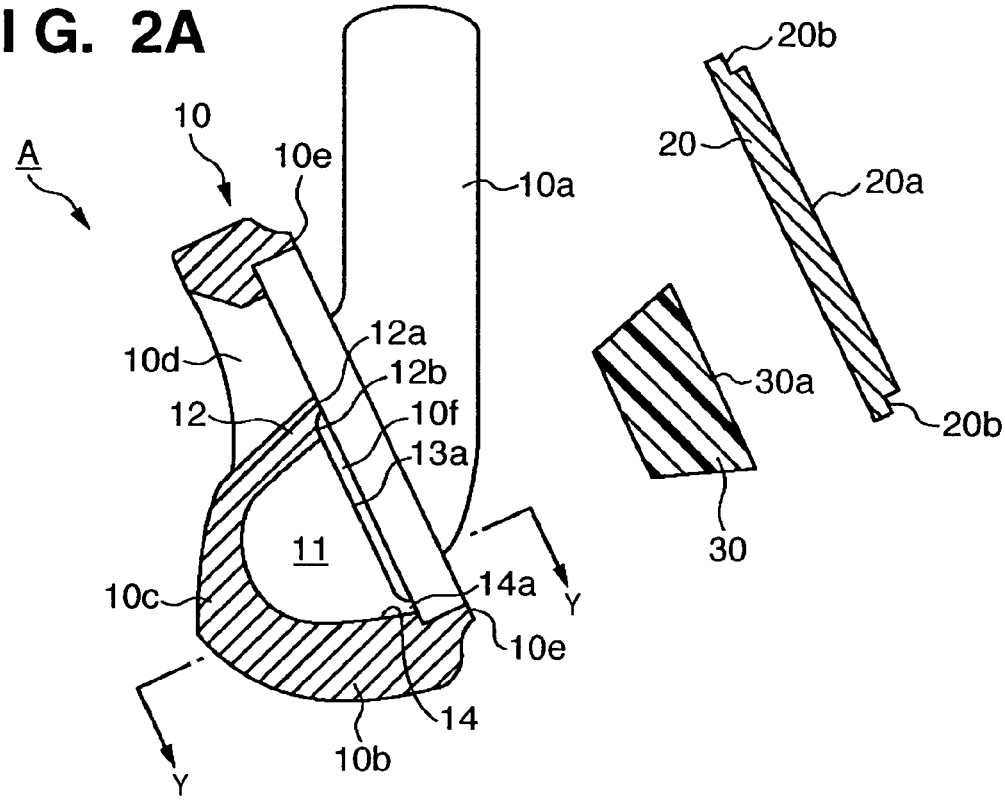
FIG. 2A is a sectional view of the golf club head A in an exploded state taken along the line X-X of FIG. 1.
Figure 2B:
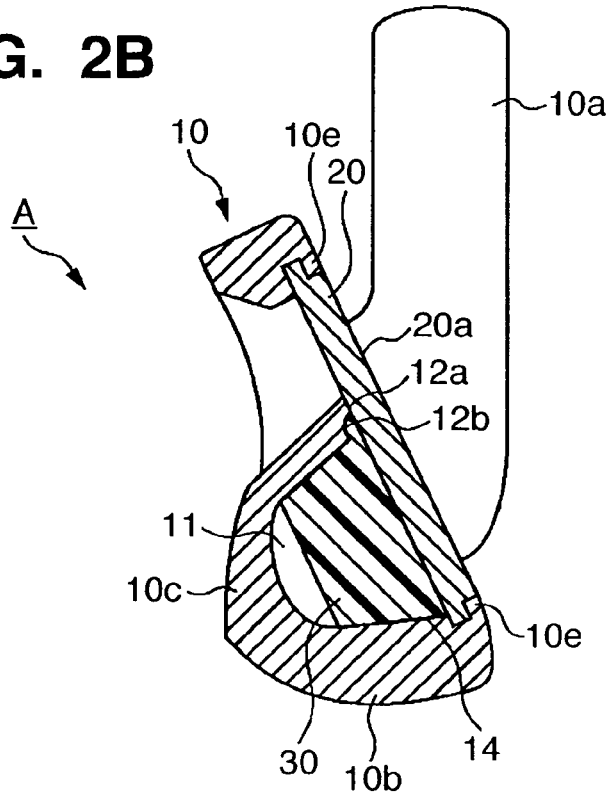
FIG. 2B is a sectional view of the golf club head A in an assembled state taken along the line X-X of FIG. 1.
Figure 3:
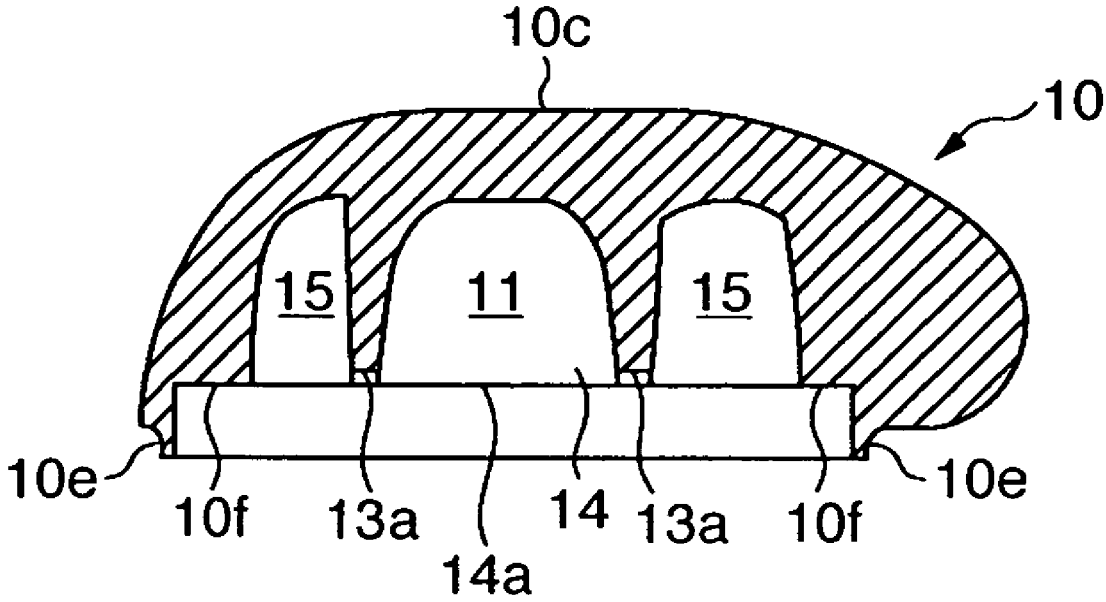
FIG. 3 is a sectional view taken along the line Y-Y of FIG. 2A.

FIG. 1 is an exploded perspective view of a golf club head A according to one embodiment of the present invention, FIG. 2A is a sectional view of the golf club head A in an exploded state taken along the line X-X of FIG. 1, FIG. 2B is a sectional view of the golf club head A in an assembled state taken along the line X-X of FIG. 1, and FIG. 3 is a sectional view taken along the line Y-Y of FIG. 2A.

The golf club head A is an iron type golf club head and includes a head main body 10 and a face plate 20 which is fixed to the front surface side of the head main body 10 to form a face surface 20*a*. Although this embodiment is exemplified by an iron type golf club head, the present invention can also be applied to another type of golf club head.

The head main body 10 integrally has a hosel portion 10*a* to be connected to a shaft, a sole portion 10*b*, and a back portion 10*c*, and is made of, e.g., stainless steel or soft iron. An opening 10*d* is formed in the upper portion of the head main body 10 to extend from the front surface side to the rear surface side, thus decreasing the weight and lowering the barycenter of the head main body 10. A rib 10*e* which defines the space where the face plate 20 is to be fixed and a contacting portion 10*f* with which the rear surface of the face plate 20 is to contact is formed on the front surface of the head main body 10.

The face plate 20 is formed with the face surface 20*a* on its front surface and a stepped portion 20*b* formed at its circumference. The rear surface of the face plate 20 forms a flat surface. For example, the face plate 20 is made of stainless steel, maraging steel, brass, a copper alloy (e.g., beryllium copper or bronze), titanium, a titanium alloy, duralumin, an amorphous metal, an FRM, or the like.

A cavity portion 11 is formed in the head main body 10 to open to the face plate 20 side and be closed on the back portion 10*c* side. The cavity portion 11 is defined by circumferential walls 12 to 14 integrally formed with the head main body 10. Of the end faces on the face plate 20 side of the circumferential walls 12 to 14, that end face of the circumferential wall 12 which is above cavity portion 11 has an contacting portion 12*a* which is flush with the contacting portion 10*f* and contacts with the rear surface of the face plate 20, and a non-contacting portion 12*b* which is spaced apart from the rear surface of the face plate 20 inside the contacting portion 12*a*. The end face of the circumferential wall 14 which is at the bottom of the cavity portion 11 comprises only an contacting portion 14*a* which is flush with the contacting portion 10*f* and contacts with the rear surface of the face plate 20. Those end faces of the circumferential wall 13 which are on the two sides of the cavity portion 11 have non-contacting portions 13*a* which are spaced apart from the rear surface of the face plate 20 and flush with the non-contacting portion 12*b*. Unlike the non-contacting portion 12*b*, the non-contacting portions 13*a* are formed throughout the entire range in the direction of thickness of the circumferential wall 13.

Second cavity portions 15 are formed on the two sides of the cavity portion 11. The cavity portions 15 serve to decrease the weight of the head main body 10. Although the cavity portions 15 are formed on the two sides of the cavity portion 11 in this embodiment, the cavity portion 15 can be formed on only one side of the cavity portion 11. Although the cavity portions 15 are left hollow in this embodiment, weights or the like to adjust the barycentric position of the golf club head A can be inserted in the cavity portions 15.

A viscoelastic body 30 is loaded in a compressed state in the space formed by the cavity portion 11 and face plate 20. A front surface 30*a* of the viscoelastic body 30 is in tight contact with the rear surface of the face plate 20.

The viscoelastic body 30 is made by mixing a plurality of types of viscoelastic materials with loss coefficients (so-called tan δ) the temperature dependences of which are different. The temperature dependence of the loss coefficient of a viscoelastic material represents the degree of the vibration attenuating effect of the viscoelastic material at any given temperature, and is related to the degree of the vibration attenuating effect of the viscoelastic material at any given frequency. More specifically, relatively, whereas a viscoelastic material with a large loss coefficient at a low temperature provides a large vibration attenuating effect in a high frequency band, a viscoelastic material with a large loss coefficient at a high temperature provides a high vibration attenuating effect in a low frequency band.

Therefore, when a plurality of types of viscoelastic materials with loss coefficients the temperature dependences of which are different are mixed, a viscoelastic body which can reduce vibration in a wider frequency range can be obtained. Such a viscoelastic body cannot be obtained from a single viscoelastic material. When the mixed viscoelastic body is mounted in the golf club A, variation in a wider frequency range can be reduced.

Examples of viscoelastic materials that are mixed to form the viscoelastic body 30 include IIR (butyl bromide composition), NBR (acrylonitrile-butadiene rubber), natural rubber, silicone rubber, styrene-based rubber, and the like. The viscoelastic body 30 can also be formed by mixing a metal powder or the like in a mixture of the viscoelastic materials described above to adjust their specific gravities.

An example of a method of mixing a plurality of types of viscoelastic materials with loss coefficients the temperature dependences of which are different is heating the respective viscoelastic materials to soften them, and then kneading the softened materials. Desirably, the viscoelastic materials are uniformly kneaded without changing their respective compositions.

Desirably, the viscoelastic body 30 is made of a plurality of types of viscoelastic materials with loss coefficients the peak value temperatures of which are different. In general, the loss coefficient of a viscoelastic material gradually decreases at each temperature with respect to the peak value temperature as a peak. Therefore, when a plurality of types of viscoelastic materials with loss coefficients the peak value temperatures of which are different are mixed, the viscoelastic body 30 which can reduce vibration in a wider frequency range can be obtained.

A plurality of types of viscoelastic materials to be mixed desirably include two types of viscoelastic materials whose peak value temperatures of the loss coefficients have a difference of 15° C. and more. The viscoelastic body 30 which can reduce vibration in a wider frequency range can be obtained by mixing such viscoelastic materials. However, if the difference between the peak value temperatures of the loss coefficients of a plurality of types of viscoelastic materials is too large, the loss coefficient of the viscoelastic body obtained by mixing the materials may largely decrease at an intermediate temperature between the respective peak value temperatures. Therefore, a plurality of types of viscoelastic materials to be mixed desirably include two types of viscoelastic materials whose peak value temperatures of the loss coefficients have a difference from 15° C. to 60° C. (both inclusive), and more desirably from 15° C. to 35° C. (both inclusive).

Desirably, a plurality of types of viscoelastic materials to be mixed include viscoelastic materials with the loss coefficient the peak value temperature of which are respectively less than −30° C. and −30° C. or more. The viscoelastic material with the loss coefficient the peak value temperature of which is less than −30° C. provides a relatively high vibration attenuating effect in the high frequency band, and the viscoelastic material with the loss coefficient the peak value temperature of which is −30° C. or more provides a relatively high vibration attenuating effect in the low frequency band. Therefore, vibration in a wider frequency range can be reduced.

The loss coefficient of the viscoelastic body 30 obtained by mixing a plurality of types of viscoelastic materials is desirably 0.3 or more in the range from −40° C. to −10° C. (both inclusive). If the loss coefficient is 0.3 or more, a higher vibration attenuating effect can be obtained.

When assembling the golf club head A having the above structure, first, the viscoelastic body 30 is inserted in the cavity portion 11 of the head main body 10. Then, as shown in FIG. 2B, the face plate 20 is inserted in the space of the head main body 10 defined by the rib 10*e* such that the rear surface of the face plate 20 tightly contacts with the contacting portion 10*f* of the head main body 10. After that, the rib 10*e* is caulked with the stepped portion 20*b* of the face plate 20 to fix the face plate 20 to the head main body 10. The viscoelastic body 30 is designed in size such that it is compressed in the cavity portion 11.

In the golf club head A according to this embodiment, the viscoelastic body 30 which is made by mixing a plurality of types of viscoelastic materials with loss coefficients the temperature dependences of which are different from each other is loaded to reduce vibration in a wider frequency range. Since the viscoelastic body 30 can reduce vibration in a wider frequency range, the single viscoelastic body 30 can implement sufficient vibration deduction. This makes it possible to reduce the number of components of the golf club head A and to simplify assembly operation, compared to a case in which a plurality of viscoelastic bodies 30 are loaded. Naturally, a plurality of viscoelastic bodies 30 can be loaded in different parts. In this case, viscoelastic bodies with loss coefficients the temperature dependences of which are different from each other can be used.

As the viscoelastic body 30 is disposed within the golf club head A in this embodiment, it does not expose outside. As the viscoelastic body 30 is protected by the head main body 10 and face plate 20, it will not be damaged. As the viscoelastic body 30 is inserted in a compressed state in the space defined by the cavity portion 11 and face plate 20, the viscoelastic body 30 comes into tight contact with the golf club head A to enhance the vibration reducing effect.

When the non-contacting portions 12*b* and 13*a* are formed on the end faces of the circumferential walls 12 and 13 that define the cavity portion 11, a gap communicating with the cavity portion 11 is formed in the end faces of the circumferential walls 12 and 13. Thus, part of the viscoelastic body 30 in a compressed state is allowed to extend into the gap.

FIG. 2B shows a state wherein part of the viscoelastic body 30 extends into the gap between the non-contacting portion 12*b* and face plate 20. Even if the compression margin of the viscoelastic body 30 is increased, when fixing the face plate 20 to the head main body 10, the head main body 10 and face plate 20 can be prevented from biting into the viscoelastic body 30. Particularly, in this embodiment, as the gap formed by the non-contacting portions 13*a* communicates not only with the cavity portion 11 but also with the cavity portions 15, the allowable extension amount of the viscoelastic body 30 increases, so that the head main body 10 and face plate 20 can be more prevented from biting into the viscoelastic body 30. Since part of the viscoelastic body 30 extends into the gap between the non-contacting portions 12*b* and 13*a* and face plate 20, the tight contact area between the viscoelastic body 30 and face plate 20 also increases more.

The viscoelastic body 30 and cavity portion 11 are designed in shape such that the front surface 30*a* is parallel to the rear surface of the face plate 20. With this structure, the front surface 30*a* of the viscoelastic body 30 comes into tight contact with the rear surface of the face plate 20 with a substantially uniform pressure, thus improving the tight contact state.

In this embodiment, the cavity portion 11 is formed in the lower side of the head main body 10, and the viscoelastic body 30 inserted in the cavity portion 11 is located in the lower side of the head main body 10. This structure can lower the barycentric position of the golf club head A, thus achieving a low barycenter. An iron type golf club hits a golf ball with its point close to the lower portion of the face surface 20*a*. Thus, the viscoelastic body 30 is located substantially behind the position of the golf ball hitting point, so that the vibration damping effect of the viscoelastic body 30 can improve.

In this embodiment, the width (d in FIG. 1) in a direction along the face plate 20 of the viscoelastic body 30 increases downward from its upper portion, and the cavity portion 11 has a shape to match this. Hence, the barycentric position of the viscoelastic body 30 is low. This can lower the barycentric position of the golf club head A, thus further achieving a low barycenter.

In this embodiment, the viscoelastic body 30 is disposed behind the face plate 20. However, the position to dispose the viscoelastic body 30 is not limited to this, but the viscoelastic body 30 can be adhered at various portions.

EXAMPLE & COMPARATIVE EXAMPLES

The golf club head A shown in FIG. 1 was subjected to comparison tests. The viscoelastic materials of the viscoelastic body 30 used in the example of the present invention and its comparative examples are as follows.

Example

Mixture of acrylonitrile-butadiene rubber and butyl bromide composition

Comparative Example 1

Butyl bromide composition alone used in the example

Comparative Example 2

Acrylonitrile-butadiene rubber alone used in the example

Note that, in the example, the mixing ratio of the acrylonitrile-butadiene rubber to the butyl bromide composition is 3:7. The mixture was heated at about 170° C. to be softened, and then uniformly kneaded.

Figure 4A:
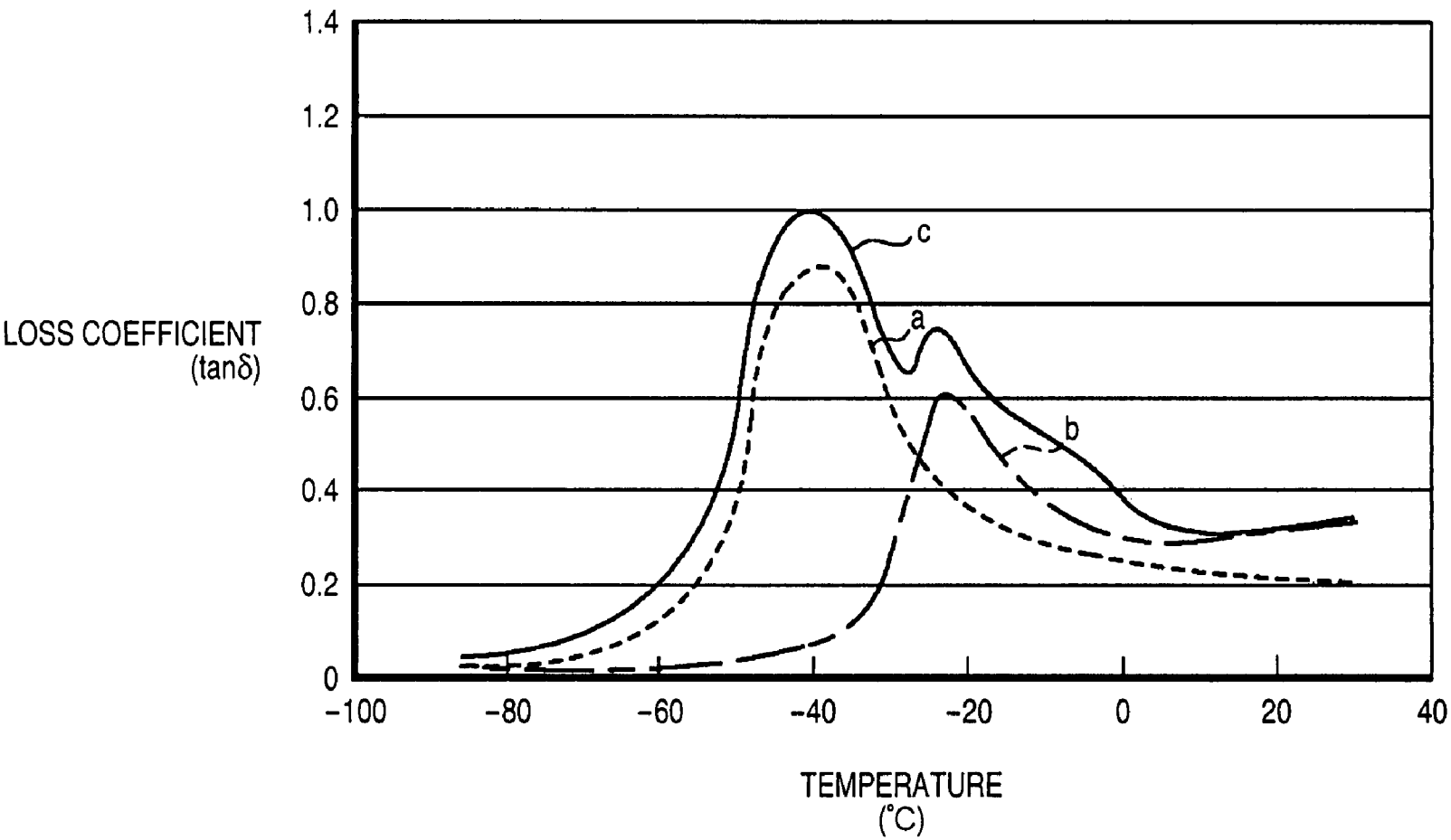
FIG. 4A is a graph showing the temperature dependences of the loss coefficients of the respective viscoelastic materials used in comparative experiments.

FIG. 4A is a graph showing the temperature dependences of the loss coefficients of the respective viscoelastic materials used in the experiment, and shows the temperature dependences at the vibration of 1 Hz. Referring to FIG. 4A, a line a represents the temperature dependence of the loss coefficient of the viscoelastic material (butyl bromide composition alone) used to form the viscoelastic body 30 of Comparative Example 1. A line b represents the temperature dependence of the loss coefficient of the viscoelastic material (acrylonitrile-butadiene rubber alone) used to form the viscoelastic body 30 of Comparative Example 2. A line c represents the temperature dependence of the loss coefficient of the viscoelastic material (mixture of acrylonitrile-butadiene rubber used in Comparative Example 2 and butyl bromide composition used in Comparative Example 1) used to form the viscoelastic body 30 of the example.

As indicated by the lines a and b of FIG. 4A, the respective viscoelastic materials used to form the viscoelastic material (mixture) of the example have loss coefficients the peak value temperatures of which are different. The difference between the peak value temperatures of the loss coefficients of the respective viscoelastic materials is about 20° C., which is higher than 15° C. The peak value temperature of the loss coefficient of one viscoelastic material is less than −30° C. (line a), and the peak value temperature of the loss coefficient of the other viscoelastic material is −30° C. or more (line b).

The viscoelastic material of the example represented by the line c of FIG. 4A shows the characteristics such as a combination of the temperature dependences of the loss coefficients of the respective viscoelastic materials used in Comparative Examples 1 and 2. The line c indicates large loss coefficients in a wider temperature range. As indicated by the line c of FIG. 4A, the loss coefficient of the viscoelastic material (mixture) of the example is 0.3 or more in the range from −40° C. to −10° C. (both inclusive).

Figure 4B:
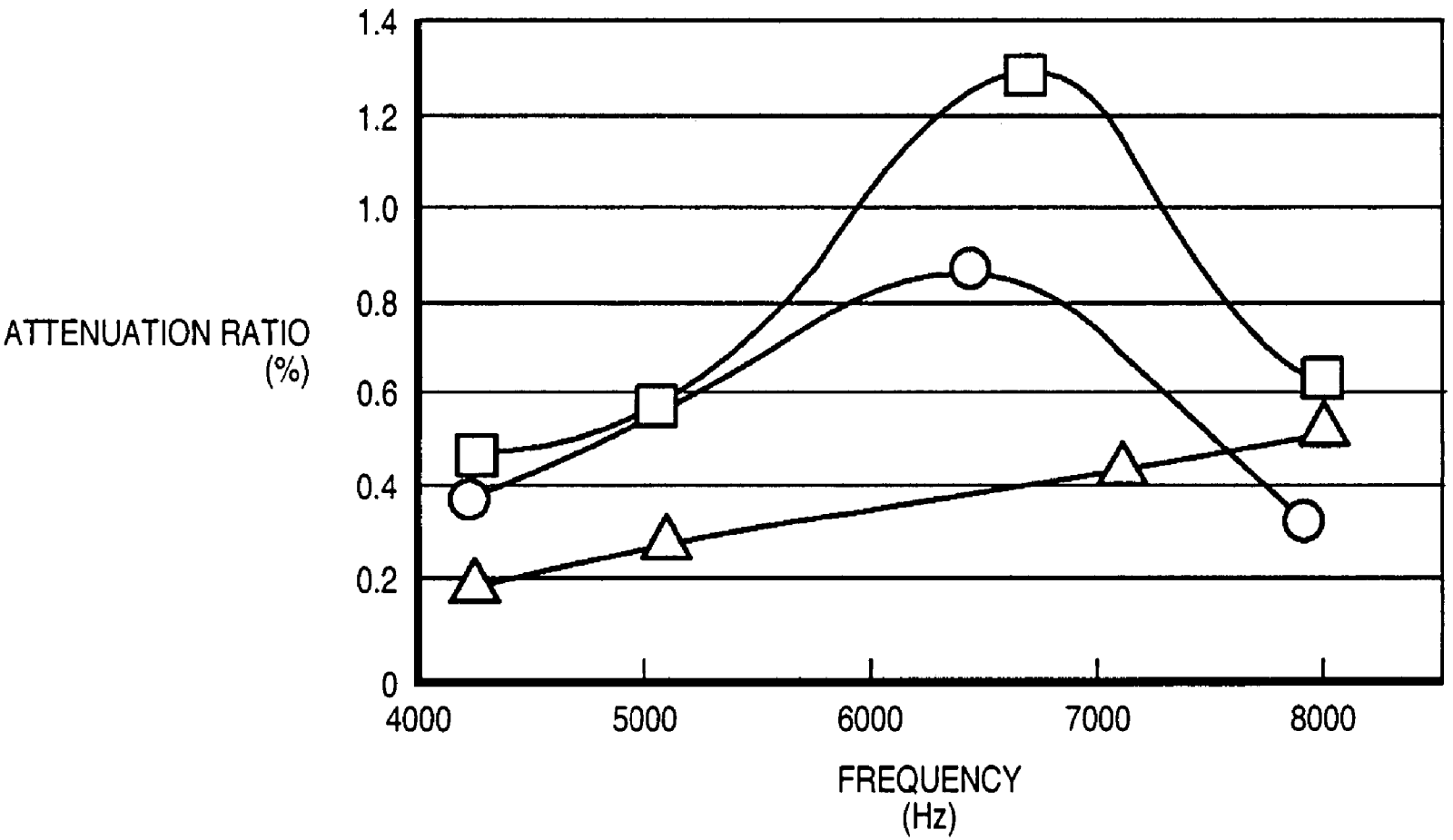
FIG. 4B is a graph showing the result of the vibration measurement experiment for golf club heads according to the example and Comparative Examples 1 and 2.

FIG. 4B is a graph showing the result of the vibration measurement experiment for golf club heads according to the example and Comparative Examples 1 and 2. In FIG. 4B, the attenuation ratios are calculated by modal analysis. The plots in FIG. 4B indicate the attenuation ratios of the resonance frequencies of the respective golf club heads. Square plots indicate the example, blank circle plots indicate Comparative Example 1, and triangular plots indicate Comparative Example 2. In the example, a high attenuation ratio is obtained in a wide frequency range.

As many apparently widely different embodiments of the present invention can be made without departing from the spirit and scope thereof, it is to be understood that the invention is not limited to the specific embodiments thereof except as defined in the appended claims.

This application claims the benefit of Japanese Application No. 2005-351281, filed Dec. 5, 2005, which is hereby incorporated by reference herein in its entirety.

What is claimed is:

1. An iron type go if club head comprising:

a head main body having a front surface side and a rear surface side;

a face plate fixed to the front surface side of said head main body to form a face surface of said golf club head;

a cavity portion formed in said head main body, said cavity portion open to the front surface side and closed by the rear surface side; and a viscoelastic body inserted in a compressed state in a space formed by said cavity portion, wherein said viscoelastic body is made by mixing a plurality of types of viscoelastic materials with loss coefficients temperature dependences of which are different, and wherein an axial edge on the front surface of a circumferential wall defining said cavity portion comprises:

a contacting portion that contacts a rear surface of said face plate; and a non-contacting portion spaced apart from the rear surface of said face plate to form a gap between said non-contacting portion and the rear surface of said face plate, the gap communicating with said cavity portion and allowing extension of the viscoelastic body into itself.

2. The head according to claim 1, wherein peak value temperatures of the loss coefficients of the plurality of types of viscoelastic materials are different from each other.

3. The head according to claim 1, wherein the plurality of types of viscoelastic materials include two types of viscoelastic materials whose peak value temperatures of loss coefficients have a difference of not less than 15° C.

4. The head according to claim 1, wherein the plurality of types of viscoelastic materials include a viscoelastic material with a loss coefficient a peak value temperature of which is less than −30° C. and a viscoelastic material with a loss coefficient a peak value temperature of which is not less than −30° C.

5. The head according to claim 1, wherein the loss coefficient of said viscoelastic body is not less than 0.3 in a range from −40° C. (inclusive) to −10° C. (inclusive).

6. The head according to claim 1, wherein a part of said viscoelastic body extends into the gap.

7. The head according to claim 1, wherein said non-contacting portion is formed at least in an upper portion of said axial edge.

8. The head according to claim 1, wherein each viscoelastic material comprises one of a butyl bromide composition, an acrylonitrile-butadiene rubber, a natural rubber, a silicone rubber, and a styrene-based rubber.

* * * * *